US011040760B2

(12) United States Patent
Barone et al.

(10) Patent No.: US 11,040,760 B2
(45) Date of Patent: Jun. 22, 2021

(54) UNDERWATER MASK

(71) Applicant: Mares S.p.A., Rapallo (IT)

(72) Inventors: Aristide Barone, Rapallo (IT); Marco Barbagelata, Genoa (IT)

( * ) Notice: Subject to any disclaimer, the term of this patent is extended or adjusted under 35 U.S.C. 154(b) by 365 days.

(21) Appl. No.: 16/232,002

(22) Filed: Dec. 25, 2018

(65) Prior Publication Data

US 2019/0225312 A1 Jul. 25, 2019

(30) Foreign Application Priority Data

Jan. 25, 2018 (IT) ..... 102018000001821

(51) Int. Cl.
*B63C 11/20* (2006.01)
*B63C 11/16* (2006.01)
*B63C 11/18* (2006.01)

(52) U.S. Cl.
CPC ..... *B63C 11/205* (2013.01); *B63C 11/16* (2013.01); *B63C 11/186* (2013.01); *B63C 2011/165* (2013.01)

(58) Field of Classification Search
CPC ..... B63C 11/186; B63C 11/16; B63C 11/205; B63C 11/20; B63C 11/207; B63C 11/22; B63C 11/12; B63C 2011/165; B63C 2011/128; B63C 2011/121; B63C 2011/123; B63C 2011/125; B63C 2011/126; A62B 18/00; A62B 18/02; A62B 18/025; A62B 18/04; A62B 18/08; A62B 18/082; A61M 16/0816
USPC ..... 128/201.11; 135/120.3; 285/184
See application file for complete search history.

(56) References Cited

U.S. PATENT DOCUMENTS 6,321,745 B1 11/2001 Christianson
10,807,687 B2 * 10/2020 Xiao ..... B63C 11/16
2014/0331997 A1 * 11/2014 Weigner ..... B63C 11/205 128/201.11

(Continued)

FOREIGN PATENT DOCUMENTS

CN 205469729 8/2016
CN 206141801 5/2017

(Continued)

OTHER PUBLICATIONS

Italian Ministry of Economic Development, Search Report (by the European Patent Office, dated Aug. 17, 2018).

*Primary Examiner* — Rachel T Sippel
*Assistant Examiner* — Kelsey E Baller
(74) *Attorney, Agent, or Firm* — Themis Law

(57) ABSTRACT

An underwater mask includes a frame, a transparent portion supported by the frame, a seal portion mounted on the frame and adapted to be positioned on a user's face, and a ventilation tube. The seal portion has a partition wall resting on the user's nose and forming upper and lower chambers, which communicate through a passage in the partition wall and a one-way valve to enable air to flow only from the upper to the lower chamber. The ventilation tube has separate channels providing communication between the upper and respectively the lower chamber and the outer environment, and a hub between tube and mask, fastened to the mask and connected to the tube by a joint, so that in a coupling position the hub and the tube are fastened, and in a releasing position the hub and the tube remain connected but the tube is free to swing.

18 Claims, 12 Drawing Sheets

(56) References Cited

U.S. PATENT DOCUMENTS

| | | | | |
|---|---|---|---|---|
| 2017/0096204 | A1* | 4/2017 | Cucchia | B63C 11/16 |
| 2018/0065719 | A1* | 3/2018 | Liao | B63C 11/16 |
| 2018/0134352 | A1* | 5/2018 | Armani | B63C 11/26 |
| 2018/0297676 | A1* | 10/2018 | Zheng | B63C 11/16 |
| 2018/0319471 | A1* | 11/2018 | Thomas | B63C 11/205 |
| 2019/0002068 | A1* | 1/2019 | Godoy | B63C 11/205 |
| 2020/0115015 | A1* | 4/2020 | Sang | B63C 11/205 |
| 2020/0130792 | A1* | 4/2020 | Huang | B63C 11/16 |
| 2020/0156745 | A1* | 5/2020 | Shiue | B63C 11/16 |

FOREIGN PATENT DOCUMENTS

| | | |
|---|---|---|
| EP | 0860184 | 8/1998 |
| EP | 1024080 | 8/2000 |
| EP | 3246242 | 11/2017 |

* cited by examiner

UNDERWATER MASK

FIELD OF THE INVENTION

The present invention relates to the field of diving masks, in particular for the so called "snorkeling" activity i.e. the practice of observing the marine environment while swimming on the surface with the head underwater.

BACKGROUND OF THE INVENTION

Generally, this kind of activity requires a mask provided with a transparent element to watch and a mouthpiece to breath. A mouthpiece is a tube having a free upper end adapted to be arranged out of the water and a lower end provided with a shaped member that the user places into the mouth in order to inhale and exhale air.

Since mouth breathing is not natural and the transparent element of the mask is prone to get fogged, masks with integral mouthpiece have been introduced that allow the nose to be also used for breathing.

The document WO2015/170013 describes such a mask comprising a frame fastening a transparent portion to a seal portion adapted to be positioned on the diver's face. The seal portion has a partition wall adapted to be rested on the user's nose, when the mask is worn, so as to form an upper chamber and a lower chamber, the lower chamber accommodating the nose and the mouth of the user. The two chambers communicate through a passage provided in the partition wall and through a one-way valve so that the air can flow from the upper chamber to the lower chamber and not vice versa.

The mask comprises a ventilation tube divided in three dedicated non-communicating channels, the first central one, at the air inlet and the other two, which are lateral, at the air outlet. The ventilation tube engages into an upper opening of the frame so as to communicate the central channel directly with the upper chamber and the side channels with the lower chamber by means of a couple of ducts obtained in the frame. This way the air inhaled reaches the nose and mouth of the user by flowing through the ventilation tube to the lower chamber by means of the upper chamber of the mask whereas the exhaled air is directly conveyed from the lower chamber to the ventilation tube in order to be ejected.

Although performing its main function pretty well, this mask has some drawbacks. Firstly, the ventilation tube is prone to break if the user does not care to pull it off when he/she is not using the mask, for example during transport. Secondly, a small breaking in the frame is enough to make the mask useless as this can cause the outflow of exhaled air inside the upper chamber. In addition, the transparent element, typically glass, has a considerable size when compared to traditional masks as it covers the whole user's face whereby it is more easily prone to accidental breakings.

SUMMARY OF THE INVENTION

It is an object of the present invention to solve, at least partly, the afore said drawbacks.

The invention achieves the objects by a mask comprising a frame, a transparent element supported by the frame, a seal portion mounted on the frame and adapted to be positioned on the user's face and a ventilation tube, which ventilation tube is sealingly and detachably connected to a hub which is integral to said mask and comprises passages communicating the inner compartment of the mask with said ventilation tube.

According to a first embodiment the hub between the ventilation tube and the mask is connected to the ventilation tube by a joint having a coupling position, in which the hub and the tube are sealingly fastened to one another in an operating position, and a decoupling position of the ventilation tube from the hub wherein the ventilation tube remains connected to the hub but is free to swing around an axis transversal to the axis of the ventilation tube itself and/or the axis of the hub.

According to a further characteristic, the coupling between the ventilation tube and the hub on the mask is of the interlocked type between the tube and the hub, limiting the rotation of the tube to the releasing position only.

An embodiment provides that the ventilation tube has an engagement end engaging into an engagement seat of the hub, said engagement end and said engagement seat being made of such axial length to define an engagement and disengagement travels of the engagement end of the ventilation tube into and from the engagement seat between two end positions, one of which is an engagement position wherein the engagement end is completely inserted into the engagement seat and the other one in which the engagement end is completely pulled out from said engagement seat, whereas the joint between the ventilation tube and the hub comprises two parts which are respectively coupled to one another so as to slide along said engagement and disengagement travels and which parts, in the disengagement condition, comprise coupling members reciprocally rotating and coupling around the joint axis of the ventilation tube to the hub.

For this purpose, the joint comprises a first and second joint elements which are integral, respectively, to the ventilation tube and the hub or vice versa, which elements are coupled so that tube and hub can reciprocally roto-translate.

An embodiment provides that a first joint portion integral to the ventilation tube or hub consists of at least one axial length extension substantially corresponding to the corresponding engagement and disengagement travels, which axial extension extends beyond the end edge of the engagement end of the ventilation tube or the engagement seat of the hub, and which axial extension bears, at its end, at least one transversal tooth engaging in a cooperating second joint portion consisting of a sliding guide respectively obtained in the engagement seat of the hub or in the engagement end of the ventilation tube, which sliding guide is oriented along the engagement and disengagement directions and has a length substantially corresponding to said engagement and disengagement travels, whereas said transversal tooth rotationally engages with the end of said sliding guide determining the stop of disengagement travel of the ventilation tube from the hub.

According to an embodiment, said first joint portion consists of at least one couple of axial parallel extensions of the engagement end of the ventilation tube or the engagement seat of the hub, which extensions are spaced out from one another along the direction transversal to the engagement/disengagement travel and/or the joint axis, and each of these extensions comprise at least one transversal tooth oriented parallel to the joint axis and, by which tooth, slidingly engage in a corresponding sliding guide.

An embodiment variation provides that for at least two of the said axial extensions the corresponding sliding teeth, which are engaged in the associated sliding guide, are oriented coaxially to one another but protruding from the corresponding extensions along reciprocally opposing directions.

According to an embodiment, the first element of the joint comprises a fin provided with a protuberance and the second element of the joint comprises a hollow to accommodate said fin, said hollow having a raised edge interfering with the protuberance of the fin to allow only specified movements of the fin inside the hollow. In the preferred embodiment, the fins are two as well as the hollows that are arranged at the opposite sides of the central channel supplying air to the upper chamber of the mask.

Advantageously, the raised edge of the hollow or hollows acts like a cam path for the protuberance of the fin or fins to allow both the translatory and rotary movements thereof.

In order to allow the fin or fins to be inserted, the hollow or hollows have a zone without raised edge, which is typically placed on the free side of the hub opposite the hub side coupled to the mask, so that the coupling is allowed by a movement approaching to the mask along a direction substantially parallel to the median longitudinal axis of the mask.

According to a further embodiment variation, the joint between ventilation tube and hub is of the film type.

An embodiment provides that said film-like joint consists of a bridge of flexible material, which is fastened with the two opposite ends respectively to the ventilation tube and the hub.

A variation of the afore said embodiment provides that said material bridge is further elastically extensible along a direction moving the ventilation tube away and nearer from and to the hub, namely along the engagement and disengagement directions of said two parts to/from one another.

According to a further variation of this embodiment, the material bridge is slidingly coupled to the hub and/or the ventilation tube since it is slidingly engaged in a fastening loop provided on the ventilation tube and hub and it is provided with a widening on each end preventing it from slipping off from the corresponding loop, with reference to the reciprocal moving away direction of the ventilation tube from the hub.

The two variations can be provided in combination to one another as a bridge of elastically flexible and extensible material can be provided as well as the slidingly fastening of said material bridge with respect to the ventilation tube and the hub.

Still according to an embodiment, the material bridge can consist of a portion or branch of a fastening belt of the mask to the user's head.

Advantageously, said material bridge is an upper end member to fasten said fastening belt of the mask to the user's head, whereby said fastening end member has contemporaneously the function of fastening the fastening belt of the mask to the user's head and serves as articulating material bridge between ventilation tube and hub.

From what above it appears clearly that the translatory movement results in the constraining/releasing of the interlocked coupling, whereas the rotary movement results in the tube swinging with respect to the hub such that the tube can lie down, in the resting position, onto the seal portion of the mask.

Typically, the interlocked coupling comprises an extension of the tube/hub that inserts into a corresponding housing provided on the hub/tube, by an approaching movement along a direction tilted off the median longitudinal axis of the mask and this engagement or interlocked coupling keeps the ventilation tube tightly in position with respect to the hub and thus the mask.

Still according to a possible embodiment variation that can be provided in combination with each of the embodiment variations afore described, the hub can be fastened to the mask or sealingly and detachably couplable to the mask itself.

An embodiment variation provides that said hub is made in a single piece with the rigid frame, whereas a different variation provides that said hub can be sealingly and separably or detachably coupled to said rigid frame of the mask.

An embodiment which can be provided in combination with anyone of the embodiments and variations described afore, provides that the seal portion of the mask comprises a partition wall adapted to be rested on the user's nose, when the mask is worn, so as to form an upper chamber and a lower chamber, the lower chamber accommodating the nose and the mouth of the user, whereas the two chambers communicate through a passage provided in the partition wall and through an one-way or non-return valve so that the air can flow from the upper chamber to the lower chamber and not vice versa, the ventilation tube comprising at least two separate channels respectively communicating the upper chamber and the lower chamber with the outer environment. This allows the tube to be folded so as to ease the mask transportation without the risk of breaking or losing the ventilation tube.

Additional features and refinements are described hereinafter.

BRIEF DESCRIPTION OF THE DRAWINGS

The features of the invention and the advantages deriving therefrom will be much clearer from the following specification of the accompanying figures, wherein.

DETAILED DESCRIPTION OF EMBODIMENTS OF THE INVENTION

Figure 1:
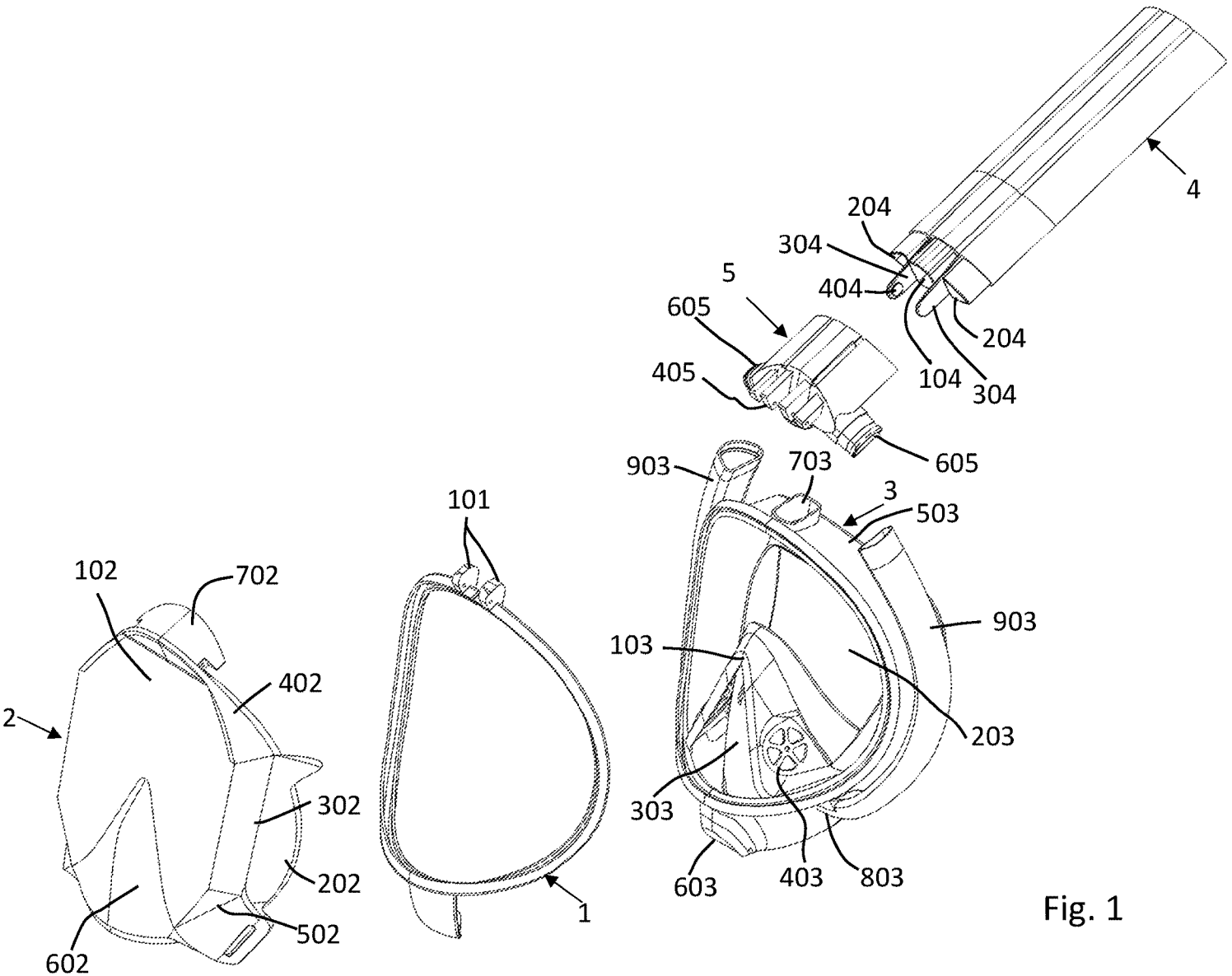
FIG. 1 shows an exploded front view of a mask according to an embodiment of the invention.
Figure 2:
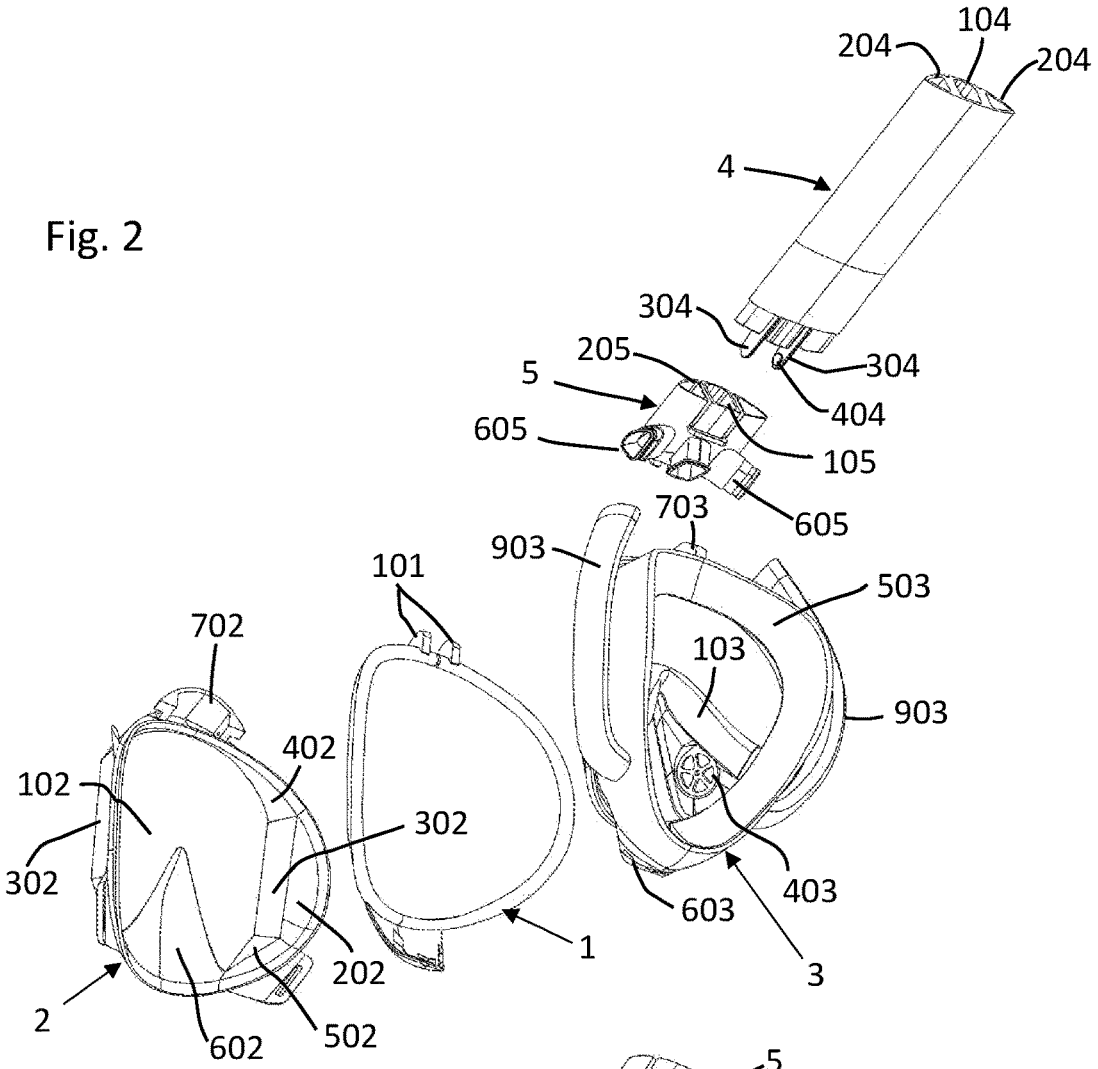
FIG. 2 shows an exploded end view of the same mask of the preceding figure.
Figure 3:
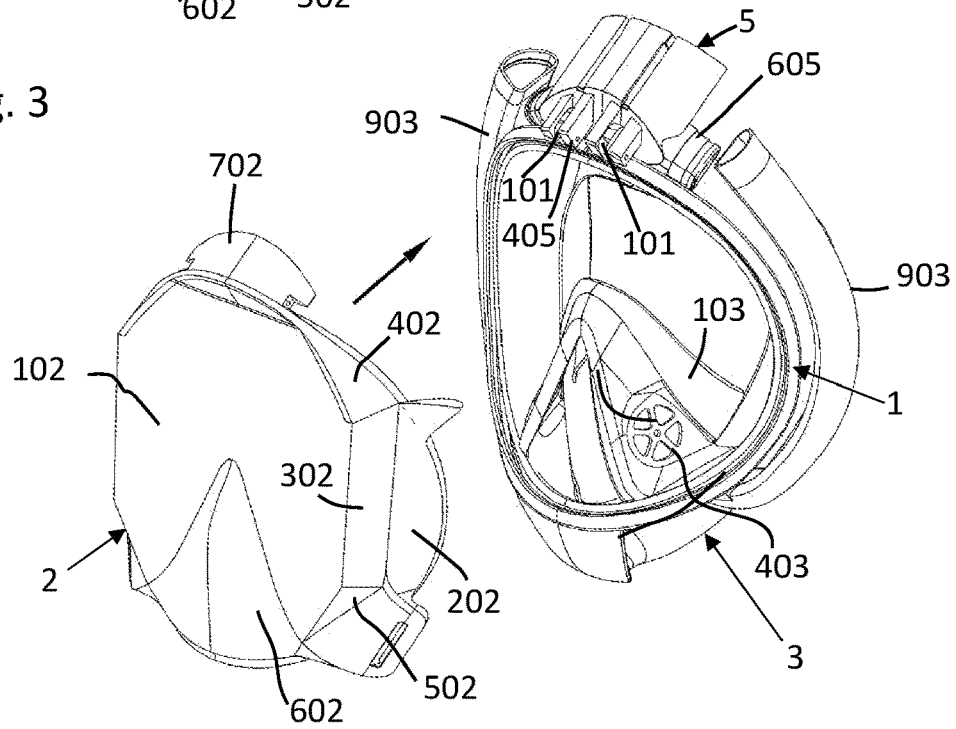
FIG. 3 shows the coupling of the transparent element to the frame of the mask.

In reference to FIG. 1, the mask according to an embodiment comprises a frame 1 having generally elongated shape, for example oval or the like, which fastens a transparent portion 2 to a seal portion 3 adapted to be sealingly positioned on and against the diver's face.

The seal portion 3, made of rubber or other flexible material such as for example neoprene, has a partition wall 103 adapted to be rested on the user's nose, when the mask is worn, so as to form an upper chamber 203 and a lower chamber 303, the lower chamber 303 accommodating the nose and the mouth whereas the upper chamber 203 the eyes of the user.

The two chambers communicate through a passage provided in the partition wall 103 in which a one-way, in particular a non-return, valve 403 is housed and oriented so that air can flow from the upper chamber 203 to the lower chamber 303 and not vice versa. In the embodiment shown, the valves 403, and the respective passages, are two and arranged on opposite sides of the partition wall 103 with respect to a median longitudinal line, i.e. the sagittal plane of the user's head.

The mask comprises a ventilation tube 4 communicating the upper chamber 203 and the lower chamber 303 with the outer environment and that will be described in detail hereinafter.

The transparent portion 2, made of glass or plastic material, is the visor of the mask through which the user is able to see to explore the marine environment. In its simplest configuration, the transparent element has a smooth convex surface having a peripheral edge which follows the contour of the frame 1 to be engaged into a throat thereof. The coupling is of the type adapted to make a seal and can provide that the edge of the transparent element is provided with a flange forming a protruding edge adapted to be engaged into an undercut compartment of the throat provided in the frame 1.

The coupling can also take place by snap-fit or shape coupling as in the mask described in the document WO2015/170013.

In the embodiment shown in the figures, the transparent element 2 has a polygonal shape with squared radiusing facets very shock- and scratch-resistant, affording a vision similar or even better than that of traditional masks.

Specifically, the transparent element 2, typically die moulded, is divided into a central portion 102, in relief, having planar development and polygonal shape, which is radiused with the perimetrical zone 202 adapted to be coupled to the frame 1 by the surfaces with tilted polygonal shape 302, 402, 502.

Underneath the central part 102 there is, at the partition wall 103 of the seal portion 3, when the mask is worn, a zone in relief 602 having polyhedral shape. Such zone in relief 602, advantageously consisting of plane surfaces having triangular shape and radiused reciprocally and with the remaining of the transparent element 2, frontally delimits the lower chamber 303 and is intended to accommodate the user's nose.

The seal portion 3, having an elongated configuration following the contour of the frame 1 and, more generally, the user's face, has a perimetrical edge 503 with four openings. The first one, positioned at the zone adapted to be arranged near the user's mouth, accommodates a purge valve 603 to eject possible water that can enter the mask.

The second opening 703 is arranged on the top of the perimetrical edge to receive air to convey into the upper chamber 203 from the ventilation tube 4.

The other two openings 803 are positioned on opposite sides of the perimetrical edge 503 and lead to the lower chamber so as to receive exhaled air that is conveyed towards the ventilation tube 4 by means of a couple of exhaust tubes 903 arranged on the perimetrical edge 503 and adjacent thereto, as shown in the figures.

For this purpose, the ventilation tube 4 is divided in three dedicated non-communicating channels, the first central one 104 at the air inlet and the other two 204, which are lateral, at the air outlet. The ventilation tube 4 engages into the upper opening of the frame 703 so as to communicate the central channel 104 directly with the upper chamber 203 and the side channels 204 with the lower chamber 303 by means of the couple of exhaust tubes 903. This way the inhaled air reaches the nose and the mouth of the user by flowing through the ventilation tube 4 to the lower chamber 303 by means of the upper chamber 203 of the mask, whereas the exhaled air is directly conveyed from the lower chamber 303 to the ventilation tube 4, in the side channels 204 to be ejected.

As better shown in FIGS. 4 to 11, the ventilation tube 4 has a hub 5 between tube and mask, which hub is intended to remain fastened to the mask and connects to the ventilation tube 4 by means of a joint having a coupling position in which the hub 5 and the ventilation tube 4 are fastened in operating position and a releasing position of the ventilation tube 4 from the hub 5 in which the ventilation tube 4 remains however connected to the hub 5, but is free to swing. In the embodiment depicted, the swing of the ventilation tube 4 with respect to the hub 5, and thus the mask, takes place along an axis perpendicular to the axis of the ventilation tube and oriented along a frontal slice plane of the head wherein the term frontal plane refers to the definition of the slice planes of the human body used in medicine.

An alternative definition of the direction of the swing axis refers to the plane central portion 102 of the frontal element 2, such a swing axis being contained in a plane parallel to said plane portion 102 of the frontal element.

When the transparent element is curved, the aforesaid definition can be extended to the plane tangential to said curved surface which, in addition, is perpendicular to the plane passing by the central axis of the ventilation tube 4.

The hub 5 consists of a central duct 105 and two side ducts 205 in which corresponding extensions of the central channel 104 and side channels 204 of the tube 4 are engaged, at an end.

The opposite end of the hub 5 is closed and has fins 405 for the engagement with corresponding fins 101 that are on the frame 1, which are kept in position by a hooking surface 702 that is on the transparent element 2 when the mask is assembled.

The central duct 305 of the hub 5, at the opposite end to the tube 4, has an opening below which engages into the hole 703 on the top of the perimetrical edge 503, whereas each one of the two side ducts 205 leads to a corresponding radiusing side branch 605 onto which the corresponding exhaust tube 903 is engaged, the seal being generated by one or more gaskets 705.

Between the central duct 105 and the two side ducts 205 there is a gap 305 intended to accommodate corresponding fins 304 that are on the tube 4, so as to form simultaneously a sliding guide and a joint. The fins 304 are flattened appendices having a protuberance with button configuration 404 on the side facing the inside.

Figure 6:
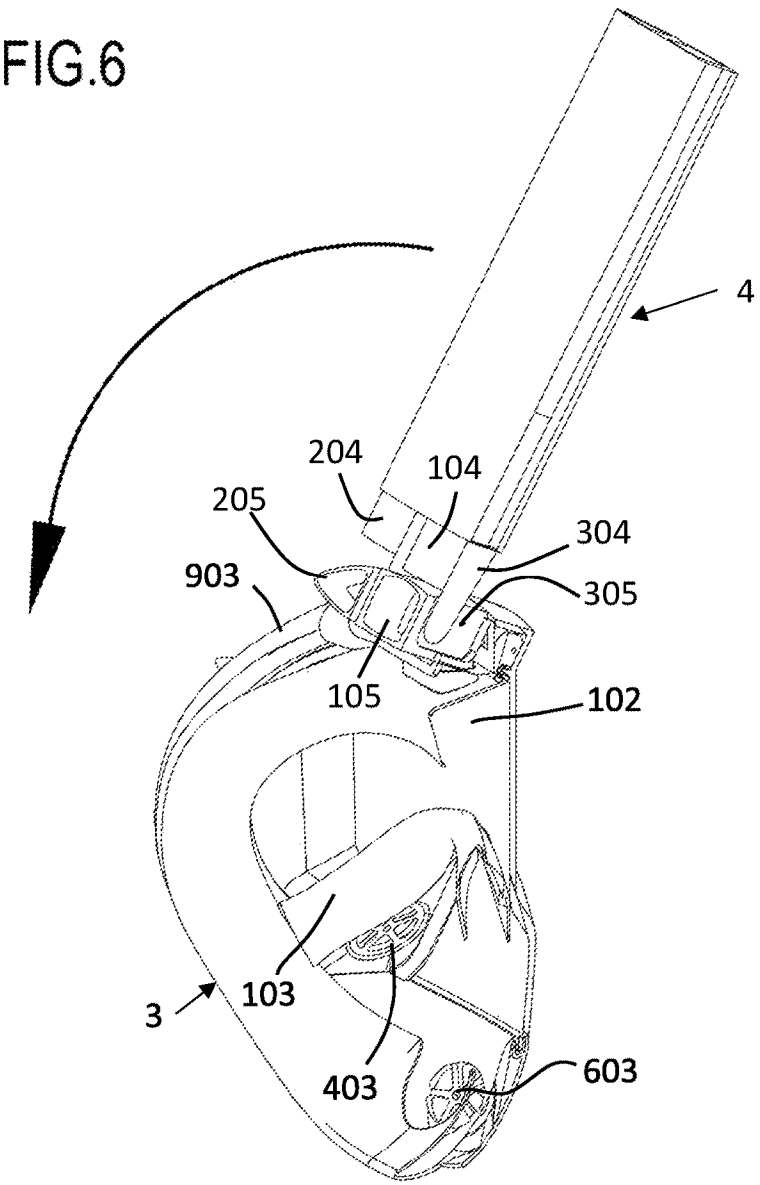
FIG. 6 shows the ventilation tube in the inserted position.
Figure 9:
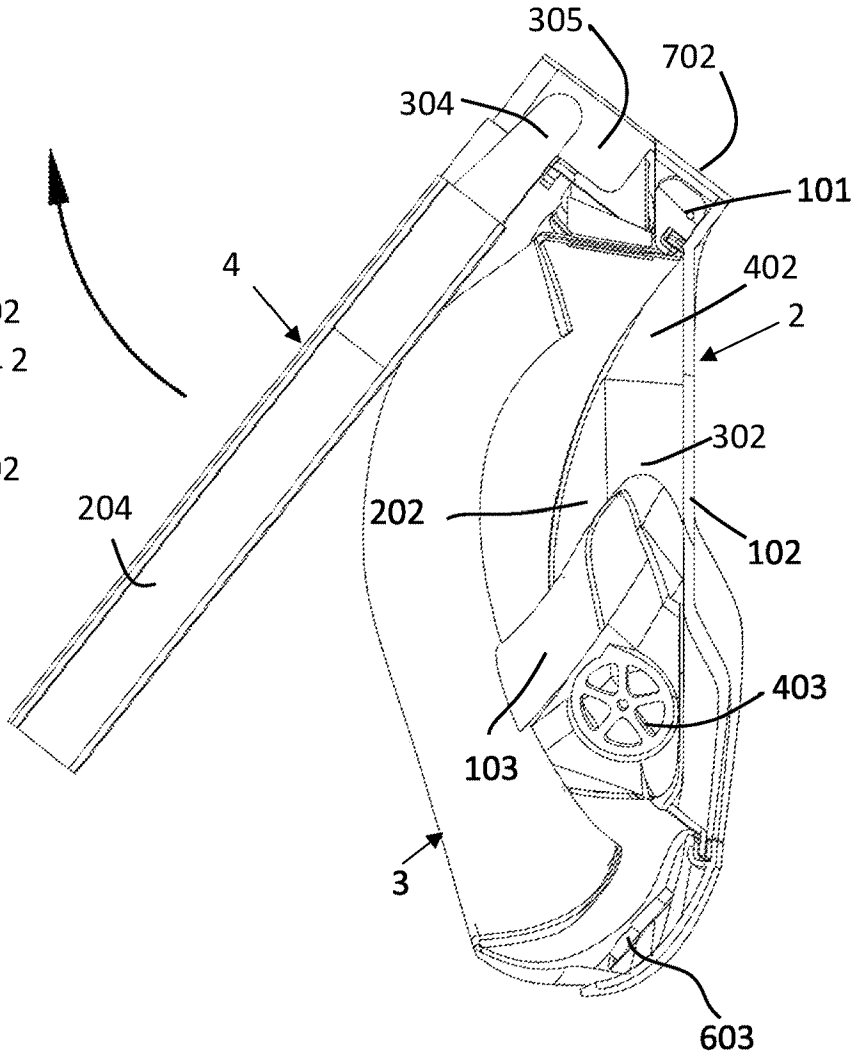
FIG. 9 shows a side section of the mask, the tube being folded.

As shown in FIG. 6, the gap 305 between the central duct 105 and each side duct 205 of the hub 5 has a rectangular section following the side contour of the central duct 105 with the longest sides facing, respectively, upwards and downwards when the mask is in vertical position.

There is a perimetrical raised edge 505 on the shortest sides and the longest side facing downwards, acting like a cam path for the button 404 of the fins 304.

Figure 5:
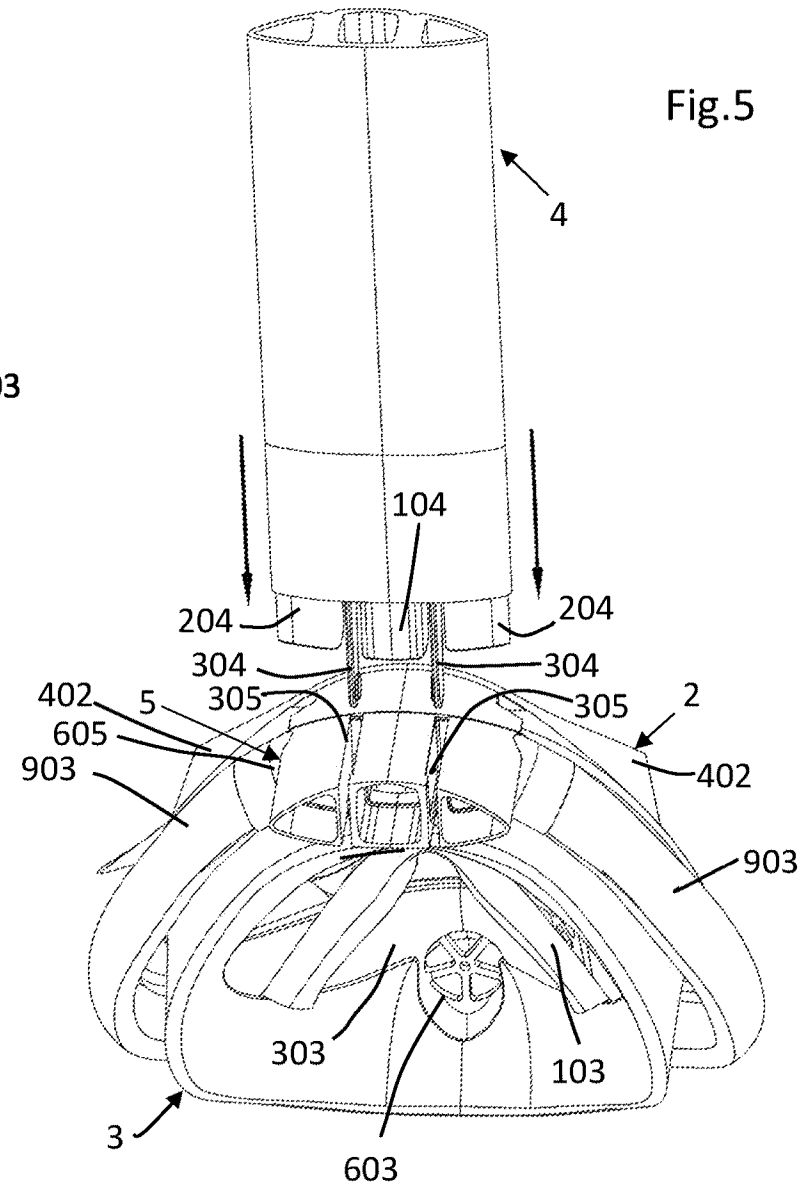
FIG. 5 shows the engagement of the ventilation tube onto the hub.
Figure 4:
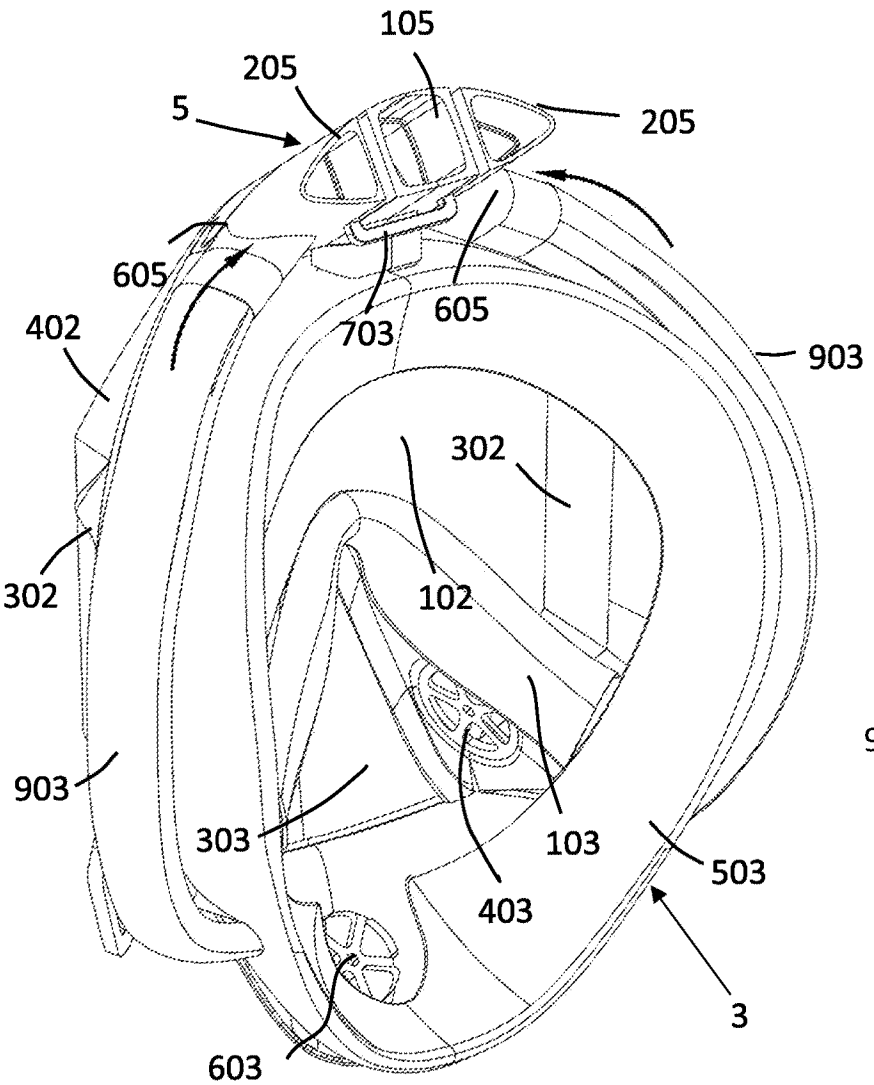
FIG. 4 shows an axonometric end view of the assembled mask with the exhaust tubes highlighted, which connect the lower chamber to the hub of the ventilation tube.
Figure 7:
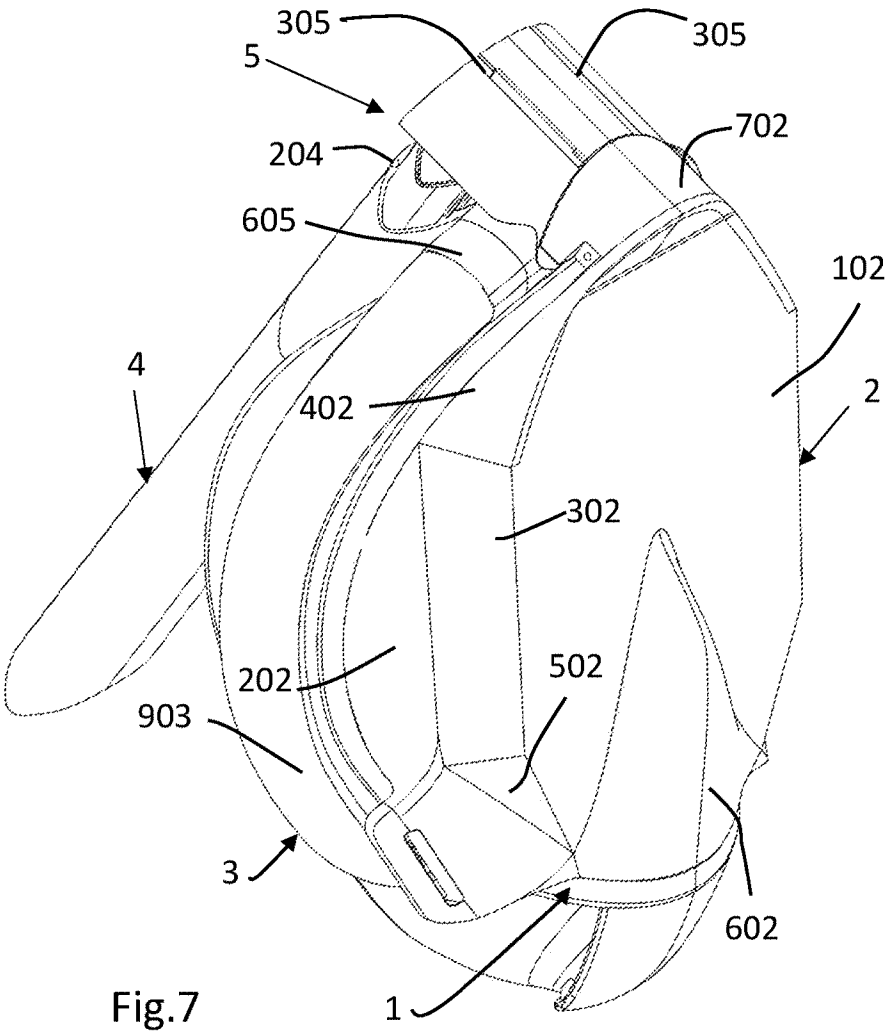
FIG. 7 shows a side view of the ventilation tube folded over on the back of the mask in resting position.
Figure 12:
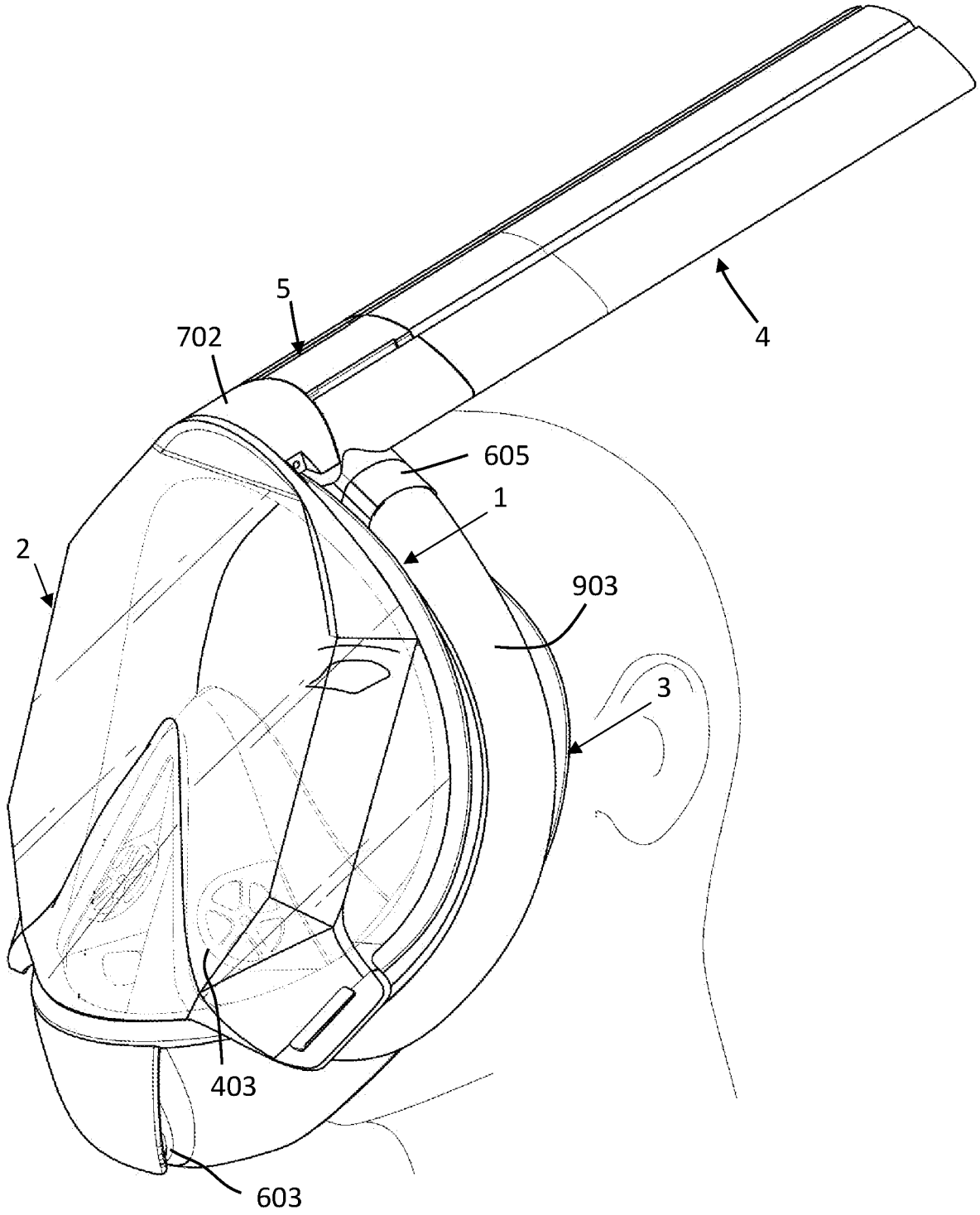
FIG. 12 shows the mask worn by a user.
Figure 13:
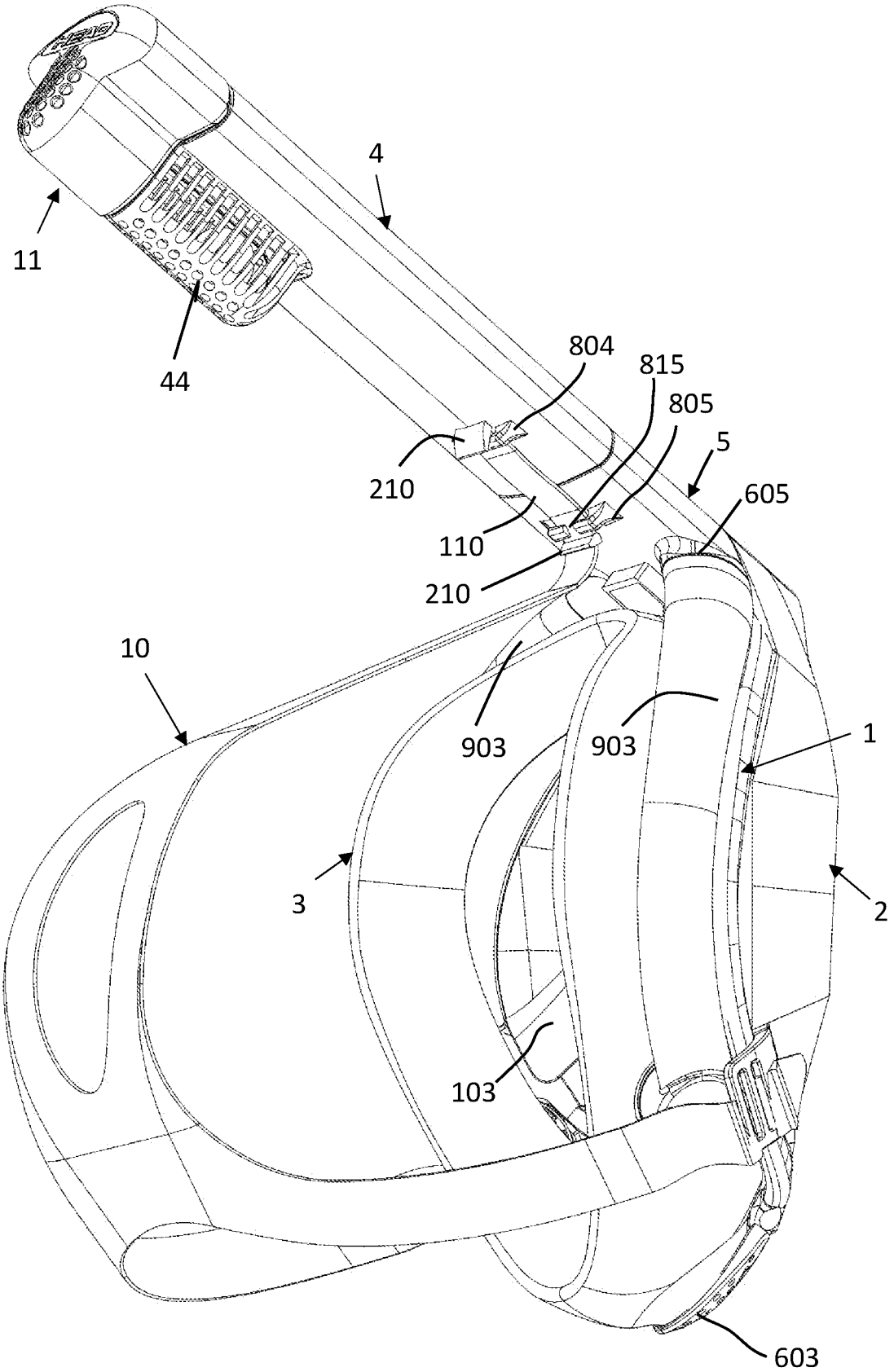
FIGS. 13 to 16 show different views along different directions of a further embodiment variation of the mask according to the present invention.
Figure 15:
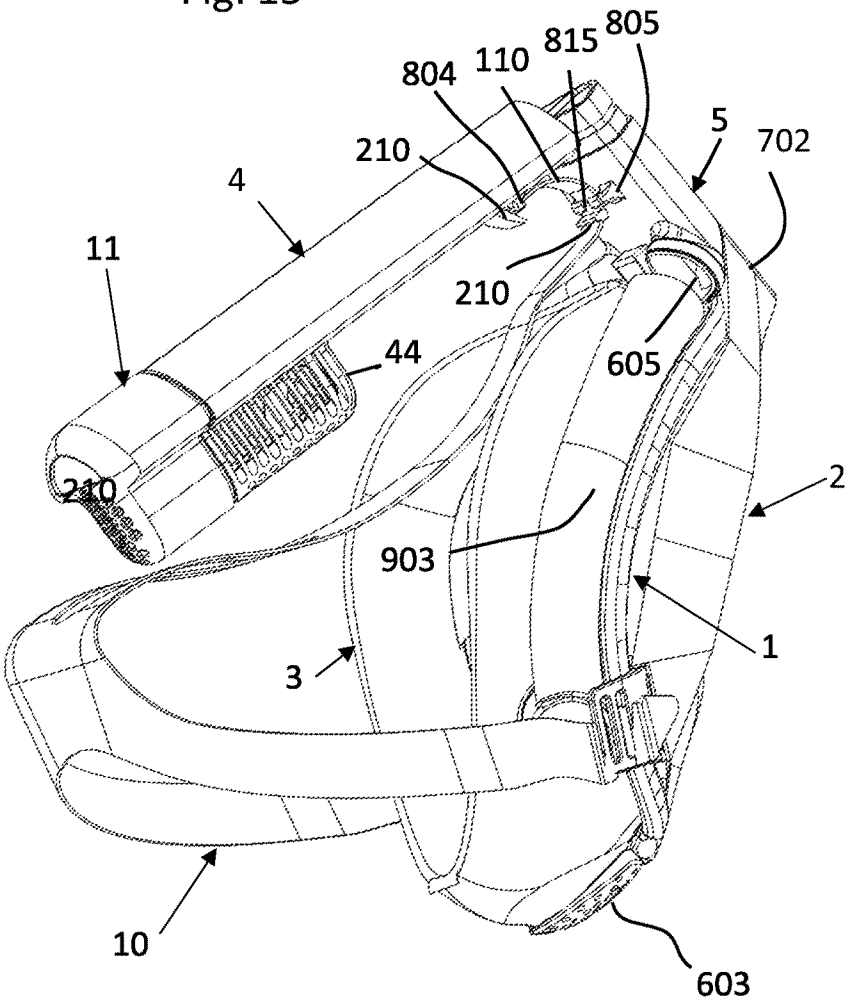
Figure 14:
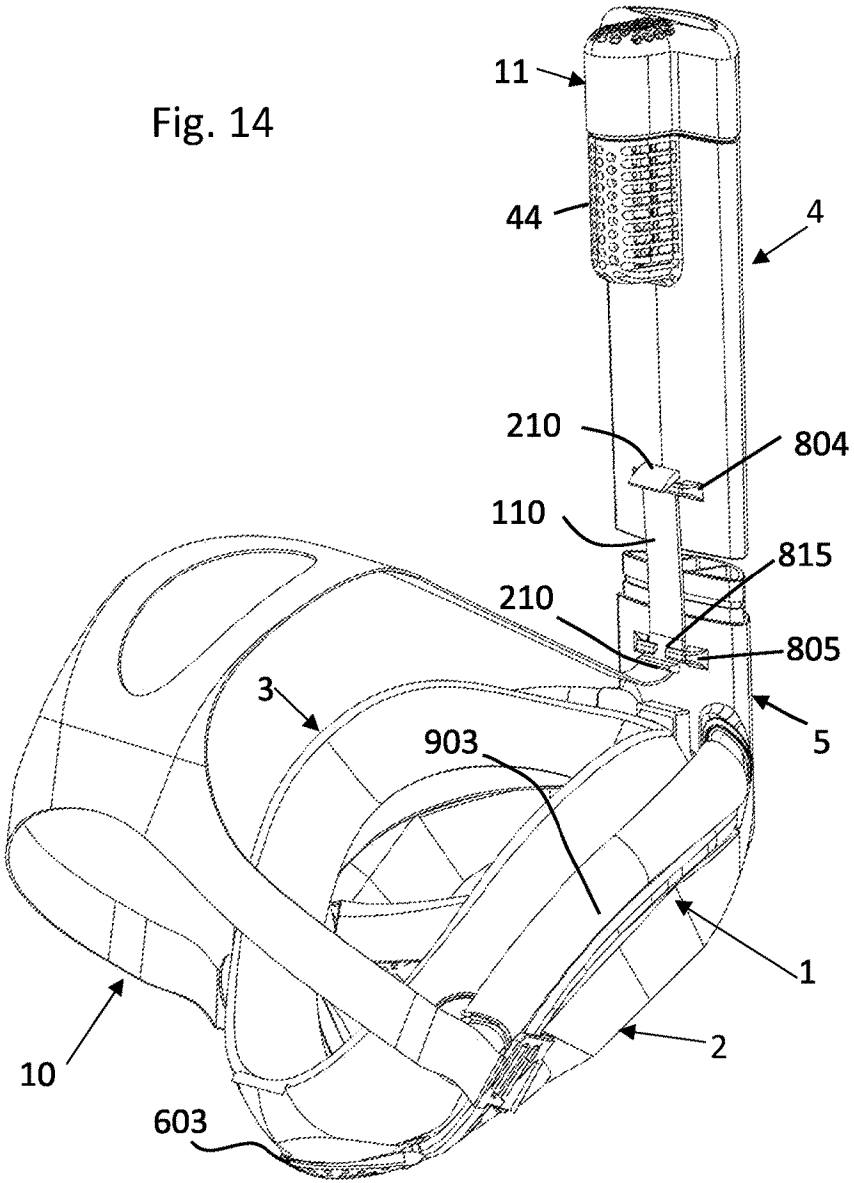
Figure 16:
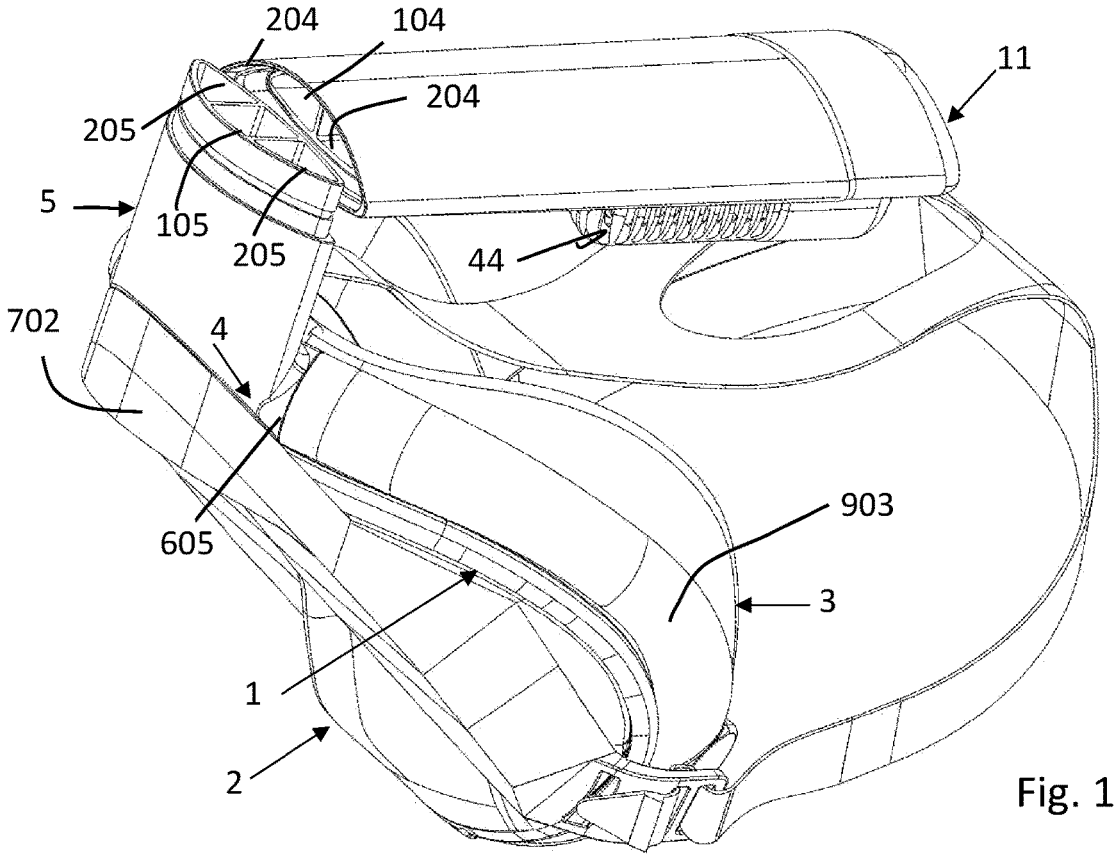

Thanks to this expedient the ventilation tube 4 can be inserted into the hub 5 from the top, as shown in FIG. 5, until the button 404 of the fins 304 abuts against the lower perimetrical edge 505. The tube 4 can thus be translated until reaching the position shown in FIG. 6, i.e. until bringing the button 404 in abutment against the side perimetrical edge 505. In this position the tube 4 can rotate in order to align the extensions of the central 104 and side 204 channels of the tube 4 to the corresponding central 105 and side 205 ducts of the hub (see FIG. 11). An additional translation in the direction shown by the arrows results in the coupling of the tube 4 with the hub 5 in the operating position (shown in FIG. 12).

Figure 8:
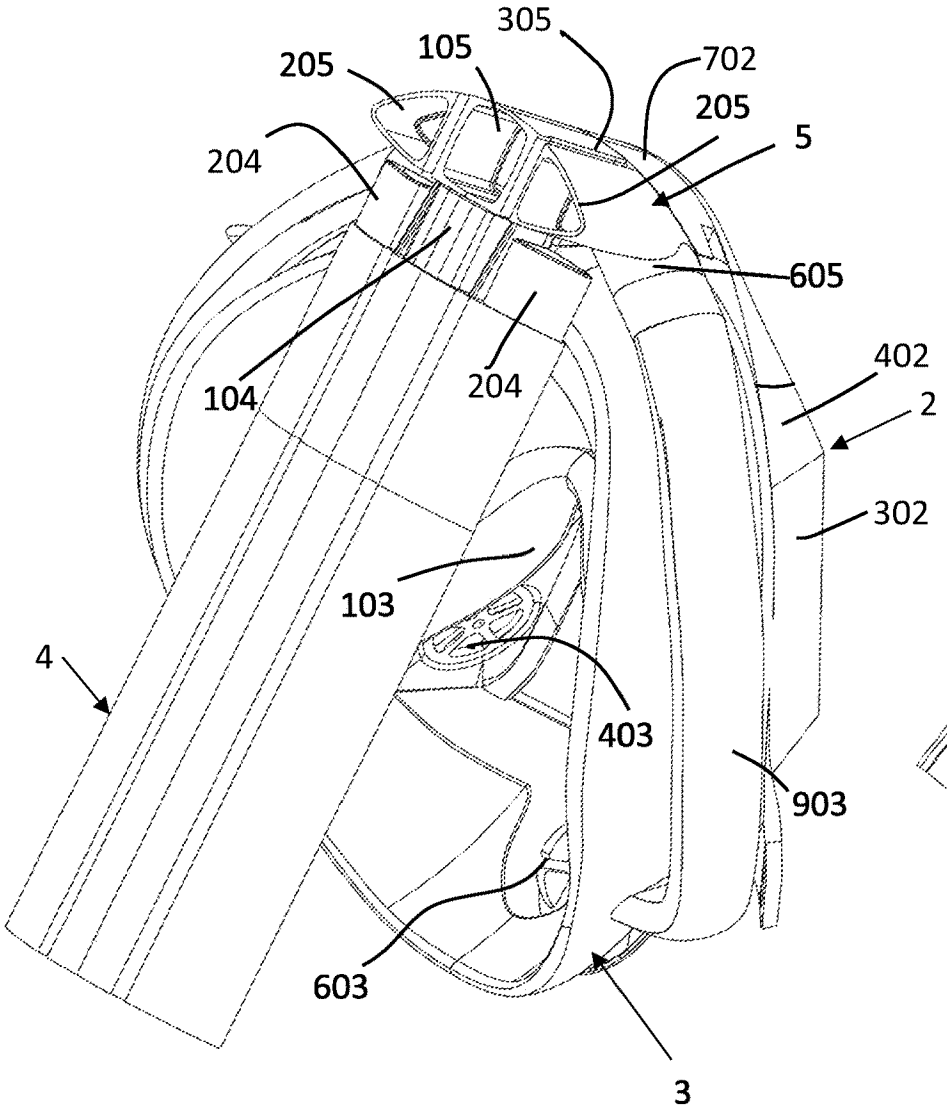
FIG. 8 shows an end view of the folded ventilation tube.
Figure 10:
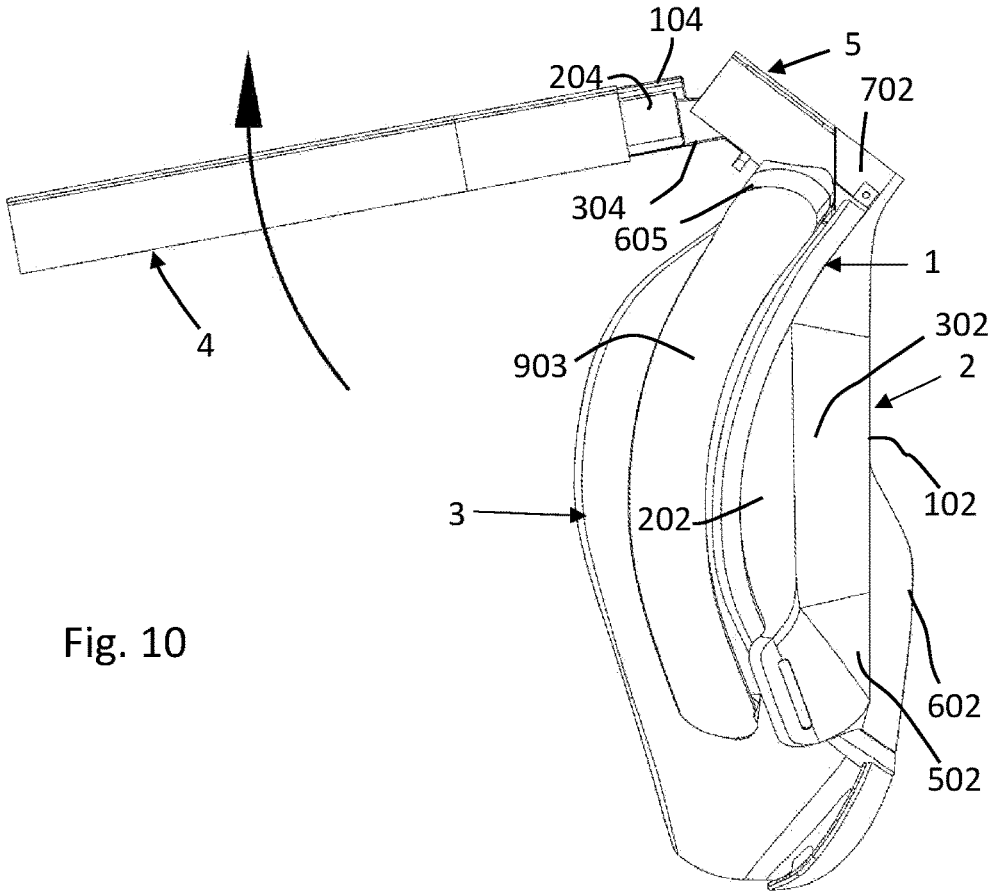
FIG. 10 shows a side section of the mask with the tube in intermediate position.
Figure 11:
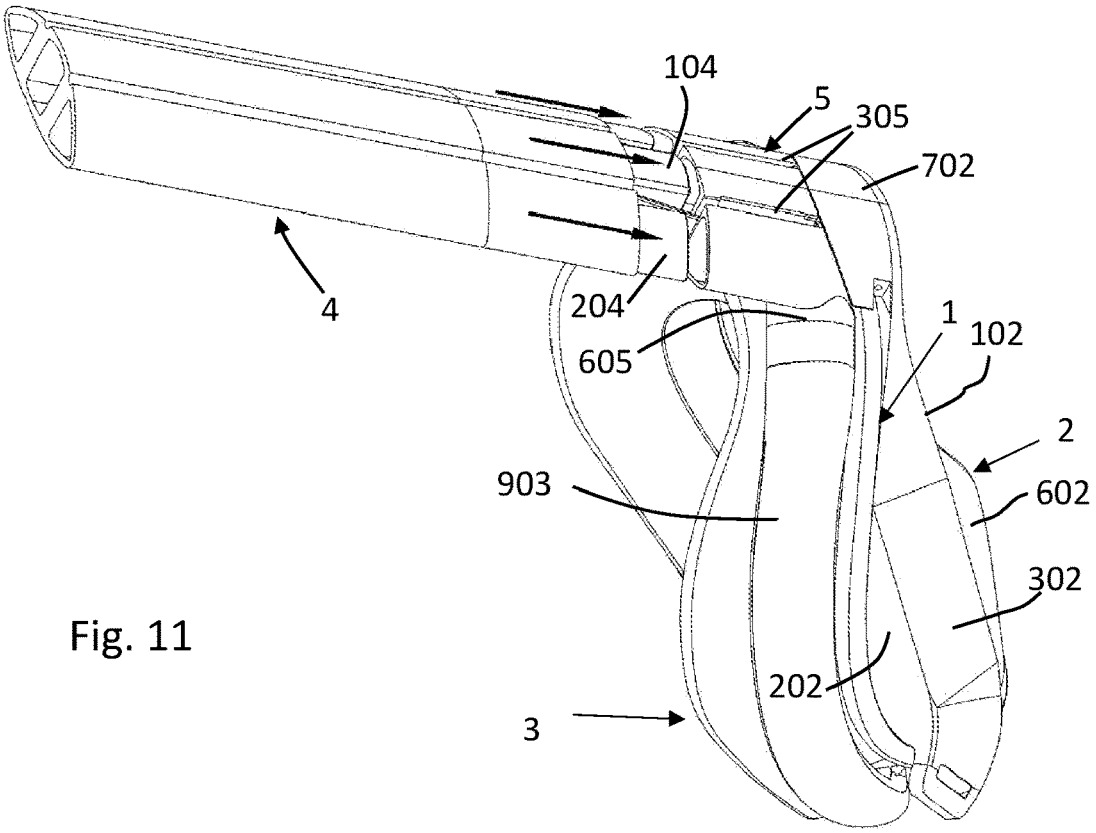
FIG. 11 shows the tube that has reached the angular operating position before its translation for the interlocking into the hub.

The resting tilted position can be reached by making a translation in opposite direction such that the tube 4 is spaced out from the hub 5. During this translation of the ventilation tube 4, the engaging end formed by the ends of the channels 204 and 104 is slipped off the ducts 105 and 205 of the hub 5 having such a section to allow the ends of the channels 204, 104 to be inserted. In the disengaged position the tube is free with respect to a rotation around the hub 5, which allows bringing the ventilation tube 4 to be rested on the back of the mask as shown in FIG. 8.

It is apparent how the sliding travel of the fins 304 between the two ends of the sliding guides consisting of the slits or gaps 305 is substantially corresponding to the engagement and disengagement travels of the ends of the channels 204 and 104 of the ventilation tube 4 into and from the ducts 105, 205 of the hub 5.

By reverse operation, i.e. rotating in the opposite way and translating the tube in the engagement position with the hub, the tube can be brought back to the operating position.

In practice the tube can be brought from an operating position to a resting position and vice versa thanks to the use of a combined translatory and rotary movement, wherein the translatory movement has the function of releasing the tube 4 from the hub 5 albeit keeping it connected thereto, so as to prevent the accidental loss thereof.

An embodiment variation of the present invention can provide that the joint axis of the ventilation tube 4 to the hub 5 has a different orientation, for example parallel to the sagittal plane and that therefore the swing of the ventilation tube 4 takes place laterally and not along the direction of the rear side of the mask.

FIGS. 13 to 19 show a further embodiment of the mask according to the present invention.

In FIGS. 13 to 19 the same reference numerals as in the example of FIGS. 1 to 12 will be used for the same portions or having the same function.

As it is apparent, the ventilation tube 4 is connected to the hub 5 by means of a film hinge.

This consists of a tongue or a bridge of flexible and elastic material that is fastened with one of its two opposite ends respectively to the ventilation tube 4 and the hub 5.

The material tongue 110 passes inside a loop 804 and 805 provided respectively on the rear or lower side of the ventilation tube 4 and the hub 5, while a thickness widening 210 like a tooth or the like on the portion of said tongue 110 protruding beyond the side of the corresponding loop 804, 805 opposite the facing loop, respectively 805, 804, being provided.

The loops can have in the middle zone an opening 814, 815 for inserting the tongue and having a length slightly larger than the thickness of the tongue 110 and remarkably smaller than the width of said tongue, such as to allow the tongue to be inserted in said loops.

The tongue 110 can slide in the two loops 804, 805, but cannot slip off the same thanks to the thickenings 210.

Advantageously, the tongue is also elastically extensible to such an extent to ensure the slip-off travel of the ends of the channels 204, 104 of the ventilation tube 4 from the ducts 105, 205 of the hub 5.

Advantageously, the distance of the loops 804, 805 and the position of the widenings 210 on the tongue 110 are such that, in the completely engaged condition of the ends of the channels 204, 104 into the corresponding ducts 105, 205, the tongue remains still tensioned at a predetermined degree such to generate a tension force along the engagement direction of the ventilation tube 4 into the hub 5. This allows applying a force which permanently stresses said ventilation tube 4 in the operating position, i.e. in the condition of complete engagement into the hub 5.

By suitably selecting the elastic characteristics of the tongue and the elongation conditions thereof in the two end positions of complete engagement of the ventilation tube 4 in the hub 5 and of complete disengagement of the ventilation tube 4 from the hub 5, a disengagement force to disengage the ventilation tube 4 from the hub 5 can be applied manually, which force counters and overcomes the force applied by the tongue 110 along the engagement direction.

Once the ventilation tube 4 has been disengaged from the hub 5, the tongue 110 reverts to the neutral condition in which it is not restrained in an elongation position and only acts as connection of the ventilation tube 4 to the hub 5, which connection allows a reciprocal relative swing of these portions.

As it is apparent from FIGS. 13 to 19, in an embodiment the tongue 110 is formed by the upper fastening end member of a fastening belt 10 to fasten the mask to the user's face, for example in the form of a fastening extension.

According to a further characteristic that can also be provided in the embodiment according to FIGS. 1 to 12, the ventilation tube 4 has, at the end opposite the frame 1 of the mask, i.e. the hub 5, an end member 11 housing in its inside a float valve which closes at least the air suctioning channel 404 when the end of the ventilation tube 4, i.e. the end member 11 mounted on said end, takes a position with respect to the surface of water in which water can penetrate inside at least said channel 104.

A further characteristic that can be provided in combination with both the variations of the joint devices that are in the two embodiments of FIGS. 1 to 12 and 13 to 19 is the particular implementation of the exhaust tubes 903.

While in the embodiment according to FIGS. 1 to 12, the two exhaust tubes 903 branch off in a single piece from the gasket 3 and directly communicate with the lower chamber 303, in the embodiment of FIGS. 13 to 19, the exhaust tubes 903 are made as separate construction portions that removably connect with an end at an opening communicating with the lower chamber 303 and provided in the gasket 3, and with the other end at the hub 5 similarly to the embodiment according to FIGS. 1 to 12.

The coupling takes place by a snap-fit interlocking coupling end member consisting of a ring provided with a crown of radial teeth provided at the ends with axial tongues elastically flexible in radial direction, the teeth and tongues engaging with the edge delimiting an opening provided in the gasket 3.

According to still a further characteristic, between the end of the exhaust tube 903 and the opening in the gasket 3 a non-return valve is advantageously provided with diaphragm shutter that is oriented to not allow the return flow from the exhaust tube 903 to the lower chamber 303.

Different embodiment variations are possible, which can comprise a separate non-return valve consisting of an independent construction part and mounted at said opening in the gasket 3.

The embodiment depicted shows a particularly advantageous embodiment variation, which provides the diaphragm shutter 130 integrated with the wall of the gasket 3 at the through opening 30 and communicating with the lower chamber 303.

Figure 17:
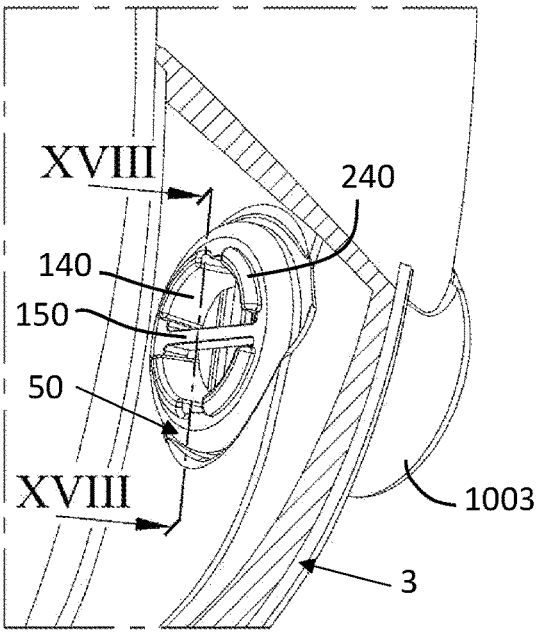
FIG. 17 shows a view of an enlarged detail of the mask according to FIGS. 13 to 16 in the zone of a non-return valve provided in the coupling zone of the exhaust tubes for ejecting the exhaled air and wherein the direction of view is from the inside of the mask outwards.
Figure 18:
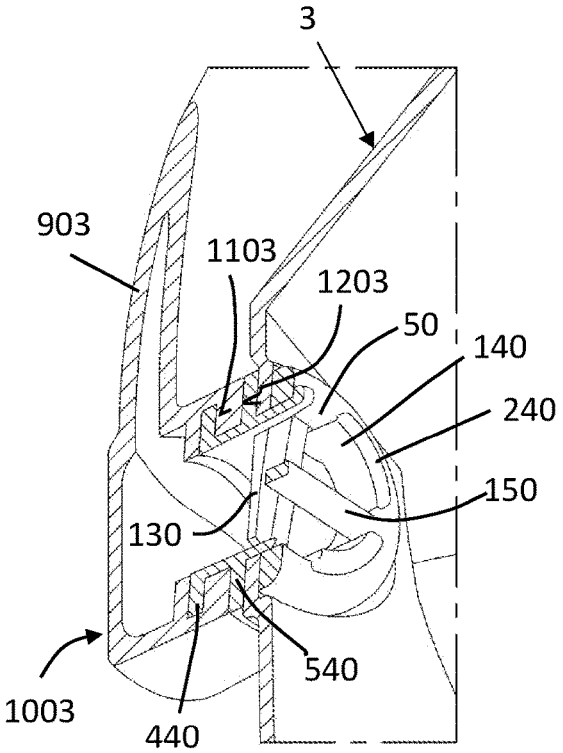
FIG. 18 shows a section of said detail along the section plane parallel to the passage axis of the valve and the line XVIII-XVIII of FIG. 17.
Figure 19:
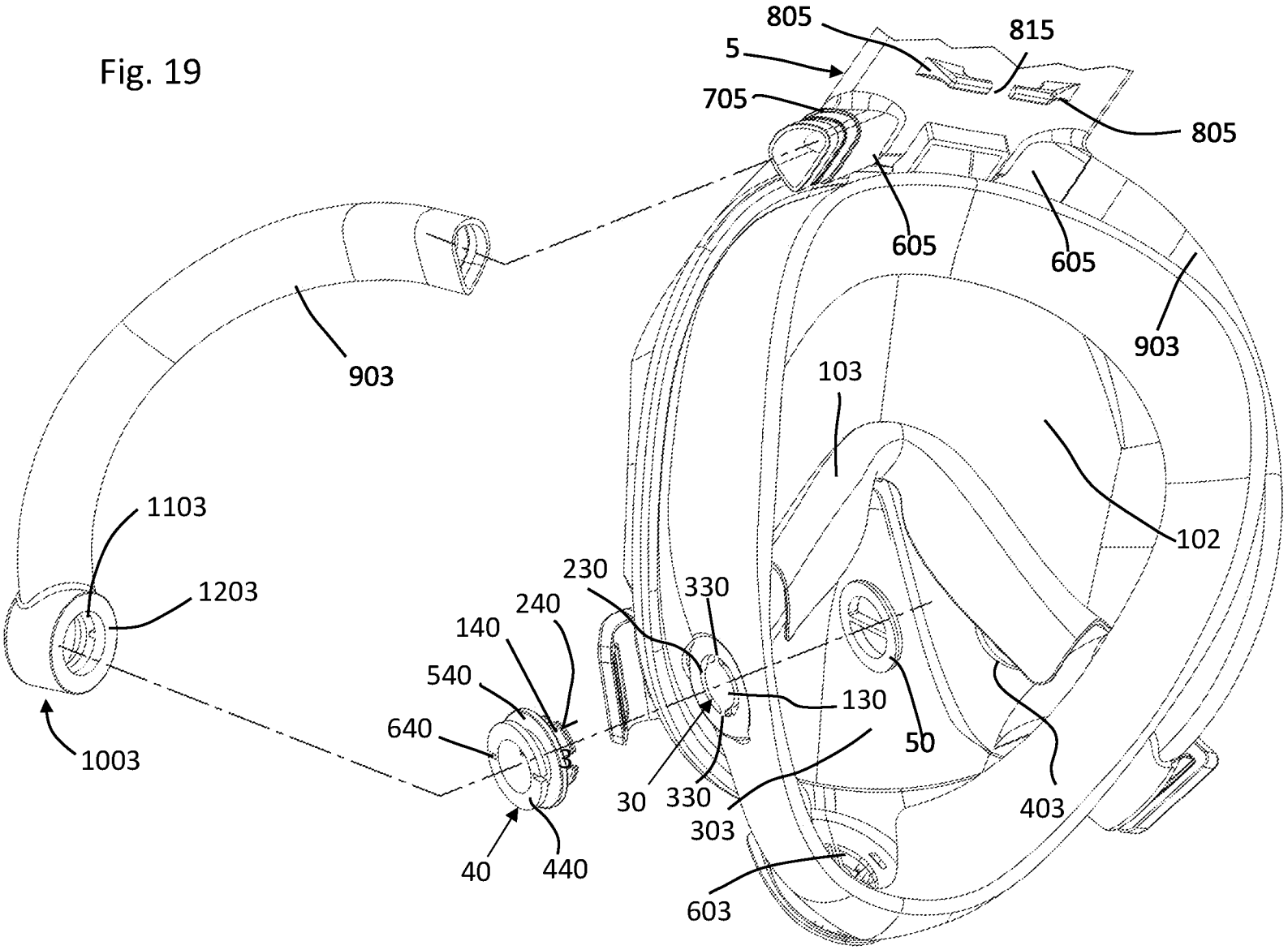
FIG. 19 shows a perspective view from the rear end of the mask, wherein a duct for ejecting the exhaled air is shown in an exploded view.

As it is apparent from FIGS. 17, 18 and 19, in the opening 30 a disk 130 is restrained in coaxial position, which disk is constituted by the same material as the gasket 3. The disk 130 has a smaller diameter than the diameter of the opening 30 and forms an annular slit 230 with the edge thereof. The disk 130 is restrained in a centered position with respect to the opening 30 thanks to two material bridges 330 reciprocally diametrically opposite.

A locking bushing of rigid material having a predetermined elasticity denoted by 40 forms a snap-fit coupling fastening end member of the end of the exhaust tube 903 to the gasket 3 in the zone of said opening 30.

In particular, said bushing 40 forms at the same time the fastening element of a valve seat 50 cooperating with the diaphragm shutter 130 to the gasket 3. The valve seat 50 consists of a ring restrained in position against the diaphragm shutter 130 by the locking bushing 40. This has, on the side facing the gasket 3, a crown of flexible axial tongues 140 having external radial teeth 240 at their ends. The tongues are arranged along a circumference line having such a radius and such an axial length that, in assembled condition, they penetrate through the slit 230 between diaphragm shutter 130 and edge of the opening 30 and overlap the end teeth 240 on the side of the ring forming the valve seat 50 and facing the inside of the lower chamber 303.

The axial length of the flexible tongues 140, compared to the overall thickness of the wall of the gasket 3 at the opening 30 and the ring constituting the valve seat 50, is such that the bushing 40 and the ring constituting the valve seat 50 are sealingly tightened against the wall of the gasket 3 at the zone surrounding said opening 30.

According to a possible further characteristic, the ring constituting the valve seat 50 can further have a central diametrical rib 150 forming an intermediate support for the two halves of the disk constituting the diaphragm shutter 130, said rib 150 being oriented transversally to the diametrical axis along which the material bridges 330 that fasten the disk to the edge of the opening 30 are aligned.

The locking bushing 40 can be made in a single piece or permanently fastened to the end of the exhaust tube 903, or said bushing 40 can be sealingly fixable by interlocked coupling or by shape coupling or by elastic force fit. The coupling is sealingly made between the exhaust tube 903 and the locking bushing 40.

An embodiment of this last variation is depicted in FIG. 19. In this case, the bushing 40 has on the side for coupling with an interlocking seat 1003, at the end of the exhaust tube 903, an annular flange 440 forming an outer radial fin intended to be engaged by elastic forcing into a corresponding annular inner throat 1103 provided in the end of the tube 903. The throat 1103 is provided at such a distance from the head side of the end of the exhaust tube 903, corresponding to the distance of the annular flange 440 from an annular countercheck surface 540, that in the condition wherein the locking bushing 40 is coupled to the end of the exhaust tube 903, the head side 1203 of said end is sealingly compressed against the annular countercheck surface 540 and possibly further by tightening the wall of the tubular length between the throat 1103 and the head side 1203 at the end of the tube 903 sealingly against the tubular length connecting the annular flange 440 to the annular countercheck 540.

Still according to a further characteristic, the annular flange 440 has at least one radial notch 640 in which a radial rib provided in the annular throat 1103 for engaging said annular flange 440 is engaged.

As it is apparent, the different embodiments of the joint of the ventilation tube to the mask and the different embodiment variations of the exhaust tubes 903 can be provided in any reciprocal combination and in particular the embodiment of the joint according to FIGS. 1 to 12 can be provided in combination with the embodiment variations of the coupling of the exhaust tubes 903 to the gasket 3 according to FIGS. 13 to 19 and the embodiments of the joint of the ventilation tube according to FIGS. 13 to 19 can be provided in combination with the embodiment variation of the exhaust tubes according to FIGS. 1 to 12.

Figure 20:
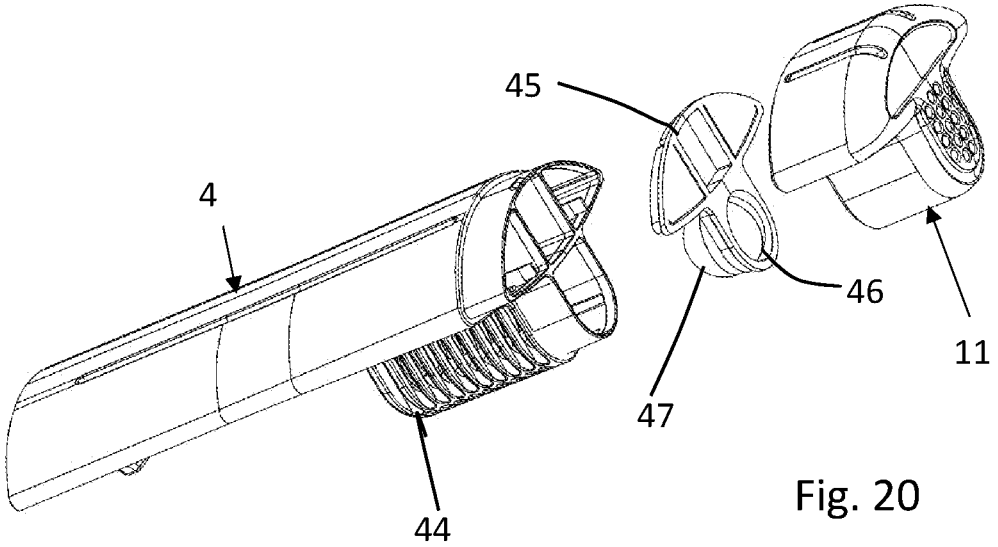
FIGS. 20 and 21 show a sectional view and a perspective exploded view of the tube and the hub thereon.
Figure 21:
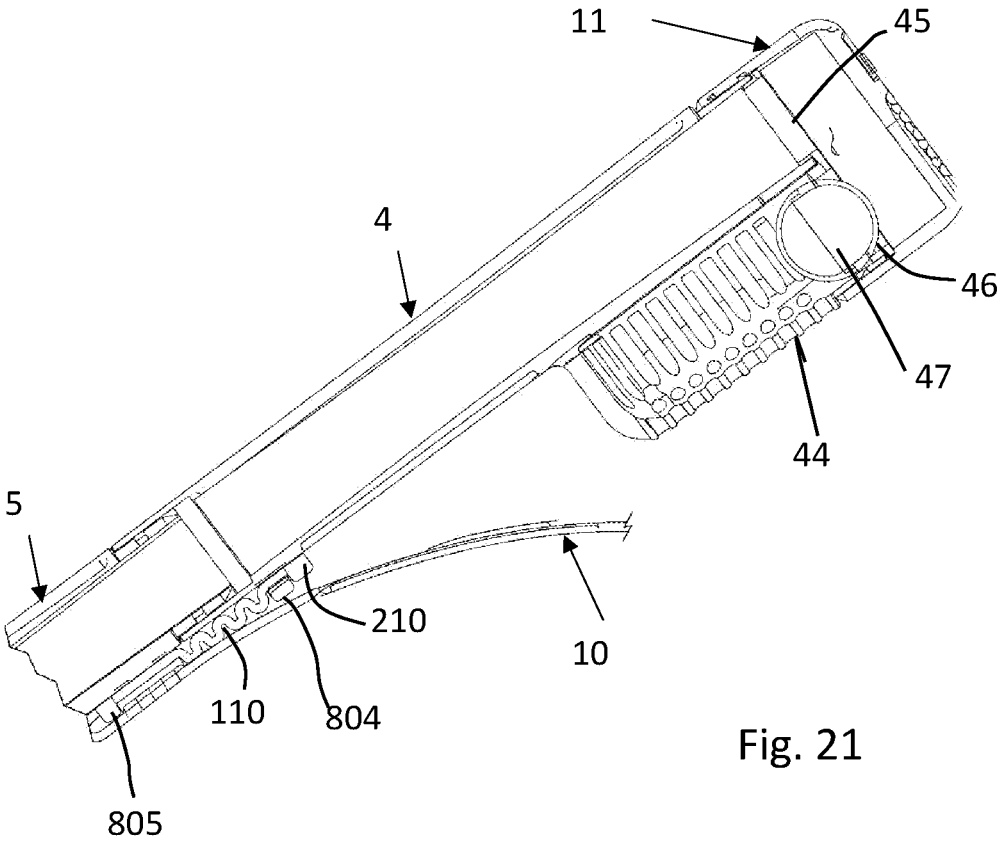

FIGS. 20 and 21 show an embodiment of the valve at the end of the tube, which valve can be provided in combination with any of the preceding embodiments.

In addition, FIGS. 20 and 21 also show an embodiment variation of the joint that is implemented according to the principle of the preceding embodiment of FIGS. 13 to 19, this variation or that of FIGS. 13 to 19 being suitable to be adopted indifferently in the two embodiments of tube.

As regard to the end member 11 on the tube 4, an embodiment provides that along an ending length of predetermined length of the tube 4, a tubular length 44 is provided and has a pierced or grid wall and generates an additional duct.

The duct forms a housing cage for a float 47, in particular with the shape of a sphere, allowing its displacement along the longitudinal axis of said tubular length 44, in this case upon the water force at immersion. The duct is positioned with respect to the tube 4 so to provide the assembly with a substantially T-shaped cross section, wherein the leg of the T consists of said tubular length 44. The tubular length is closed by the pierced wall at the end facing the mask, whereas it is open at the end facing the end member 11.

The end member 11 has a cross section having a shape substantially corresponding to the T one of the ending length of the tube with the tubular segment 44 and axially extends said assembly up to a head wall closed to the outside.

The end member 44 is permanently or removably sealingly fastened, for example by sealingly fitting onto an engagement end extension of the tube 4 and the tubular length 44. Between the end member 11 and the port of the tube 4 and length 44 an element 45 is provided and forms a diaphragm shutter acting as a non-return valve, which is configured so that to prevent the return flow into the exhaust ducts of the tube 4. An appendix 46 coinciding with the port of the tubular length 44 forms a valve seat like an annular gasket, which is intended to cooperate with the shutter consisting of the spherical float 47.

When the tube is immersed, the water pushes the float 47 towards the end member 11 and along the direction of the annular seat 46 with which there is a contact, closing the passage of water towards the inside of the tube 4. In the condition in which the float 47 is not immersed, the weight of the float 47 moves it away by gravity from the valve seat 46 in the opening condition of the tube 4.

In connection with what above, it is relevant that the floating 47, shutter 45 and valve seat 46 assembly is made as an integral construction piece having a cross section with shape substantially the same as that of the tube 4 and end length 44 assembly and with sizes suitable to be restrained in position between the end member 11 and the end of said tube 4.

In an embodiment, the valve seat can be in form of an O-ring with a mantle surface with a circular cross section, at least for a part of the mantle surface facing the inside of the said seat of annular valve.

According to an additional characteristic which does not need to be provided in combination with the characteristics described in reference to the tube 4, at the end member 47 and the members 45 to 47, but can also be provided in combination with any of the preceding embodiments of the mask, the tongue 110 forming the film hinge between the tube 4 and the mask, i.e. the hub 5, has in the length comprised between the loop 804 on the tube 4 and the loop 805 on the hub 5, a wavy length 500 increasing the elastic flexibility in relation to curvatures along axes parallel to the faces of the tongue 110 and perpendicular to the longitudinal extension thereof and increasing the elastic extensibility thereof.

In the example the length 500 is wavy like a sinusoid, but it can also be zigzag or fret shaped or the like.

Although the description mostly refers to a mask with double channel for ejecting the air, the teachings of the present invention can also be applied in simpler masks providing the use of a single duct for the exhaled air both at the ventilation tube level and the duct conveying the air from the lower chamber to the ventilation tube. Such a duct can, inter alia, be of any type and can also be obtained inside the mask, for example in an interspace of the seal portion, or in the frame.

All without departing from the afore-stated guiding principle and claimed as follows.

The invention claimed is:

1. A mask comprising:

a frame (1);

a transparent portion (2) supported by the frame;

a seal portion (3) mounted on the frame (1) and adapted to be positioned on a user's face; and a ventilation tube (4), sealingly and detachably connected to a hub, the hub being integral with said mask and comprising passages communicating an inner compartment of the mask with said ventilation tube to supply breathing air and discharge the expiratory air, wherein the hub (5) is connected to the ventilation tube (4) by a joint having a coupling position, in which the hub (5) and the tube (4) are sealingly fastened to one another in an operating position, and a decoupling position, in which the ventilation tube (4) and the hub (5) are decoupled, in which the ventilation tube (4) remains connected to the hub (5) but is free to swing around an axis transversal to an axis of the ventilation tube (4) or an axis of the hub (5), wherein the joint between the ventilation tube (4) and the hub (5) is a film joint (110); and wherein the film joint is composed of a portion or branch of a fastening belt (10) of the mask to the user's head.

2. The mask according to claim 1, wherein the ventilation tube (4) has an engagement end (104, 204) engaging an engagement seat (105, 205) of the hub (5), said engagement end (104, 204) and said engagement seat (105, 205) having a same axial length, thereby defining an engagement and disengagement travel of the engagement end (104, 204) of the ventilation tube (4) into and from the engagement seat (105, 205) between two end positions, wherein in a first one of the two end positions of the engagement end (104, 204) is completely inserted into the engagement seat (105, 205) and in a second one of the two end positions of the engagement end (104, 204) is completely pulled out from said engagement seat (105, 205), wherein the joint between the ventilation tube (4) and the hub (5) comprises two parts which are respectively coupled so as to slide for said engagement and disengagement travel, said two parts, when disengaged, comprising coupling members rotatable in relation to one another around an axis joining the ventilation tube (4) to the hub (5).

3. The mask according to claim 2, further comprising an interlocked coupling between the tube (4) and the hub (5), the joint comprising a first (304) and a second (305) element respectively integral with the tube (4) and the hub (5) or vice versa, said first and second elements being coupled to enable the tube and the hub to roto-translate reciprocally, a rotary movement being allowed only at a releasing position of the interlocked coupling.

4. The mask according to claim 1, wherein a first joint portion integral to the ventilation tube (4) or hub (5) has at least one axial length extension (104, 204) corresponding to engagement and disengagement travels, said axial length extension (104, 204) extending beyond an end edge of an engagement end (104, 204) of the ventilation tube (4) or an engagement seat (105, 205) of the hub (5), said axial extension (104, 204) bearing, at an end, at least one transversal tooth engaging in a cooperating second joint portion consisting of a sliding guide respectively obtained in the engagement seat of the hub or in the engagement end of the ventilation tube, said sliding guide being oriented along engagement and disengagement directions and having a length corresponding to said engagement and disengagement travels, wherein said transversal tooth rotationally engages with an end of said sliding guide determining a stop of the disengagement travel of the ventilation tube from the hub.

5. The mask according to claim 1, wherein a first joint portion includes at least one couple of axial parallel extensions of the engagement ends of the ventilation tube or an engagement seat of the hub, said extensions being spaced from one another along a direction transversal to an engagement and disengagement travel and/or an axis of the joint, each of said extensions comprising at least one transversal tooth oriented parallel to the axis of the joint and said transversal tooth, slidingly engaging in a corresponding sliding guide.

6. The mask according to claim 5, wherein for at least two of said at least one couple of axial parallel extensions the corresponding transversal teeth, which are engaged in the corresponding sliding guide, are oriented coaxially to one another but protruding from the corresponding extensions along reciprocally opposing directions.

7. The mask according to claim 3, wherein the interlocked coupling comprises an extension of the ventilation tube or the hub which inserts into a corresponding housing provided on the hub or the ventilation tube by an approaching movement along a direction tilted off a median longitudinal axis of the mask.

8. The mask according to claim 1, wherein the ventilation tube (4) and the hub (5) comprise a central channel (104, 105) and a couple of side channels (204, 205), the joint comprising a couple of fins (304) integral with the tube (4) and a corresponding couple of hollows (305) obtained in the hub (5) between the central channel (105) and the side channels (205).

9. The mask according to claim 1, wherein said film joint (110) consists of a bridge of flexible material, which is fastened at two opposite ends respectively to the ventilation tube (4) and the hub (5).

10. The mask according to claim 1, wherein film joint (110) is elastically extensible along a direction moving the ventilation tube (4) away from and nearer to the hub (5), along engagement and disengagement directions of the tube and the hub to and from one another.

11. The mask according to claim 1, wherein the film joint (110) is slidingly coupled to the hub (5) or the ventilation tube (4) by being slidingly engaged in a fastening loop (804, 805) provided on the ventilation tube (4) and hub (5) and is further provided with a widening on each end that prevents the film joint from slipping off, with reference to a reciprocal moving away direction of the ventilation tube (4) from the hub (5).

12. The mask according to claim 1, wherein said film joint (110) is an upper end member that fastens a fastening belt (10) of the mask to the user's head, whereby said fastening end member has contemporaneously a function of fastening the fastening belt of the mask to the user's head and operates as an articulating material bridge between the ventilation tube and the hub.

13. The mask according to claim 1, wherein the seal portion (3) comprises:

a partition wall (103) adapted to be sealingly rested on the user's nose, when the mask is worn, so as to form an upper chamber (203) and a lower chamber (303), the lower chamber accommodating the user's nose and mouth, wherein the upper and the lower chambers communicate through a passage in the partition wall (103) and through a one-way valve (403) so that air can flow from the upper chamber (203) to the lower chamber (303) and not vice versa; and the ventilation tube (4) comprising at least two separate side channels (104, 204) providing communication between the upper chamber (203) and respectively the lower chamber (303) and an outer environment.

14. The mask according to claim 13, wherein the hub (5) has a couple of openings for engagement of corresponding ducts (903), the couple of openings providing communication between the lower chamber (303) and the side channels (204) of the ventilation tube (4).

15. The mask according to claim 14, wherein the corresponding ducts are connection tubes arranged outside of both the frame (1) and the seal portion (3).

16. The mask according to claim 14, wherein the corresponding ducts are obtained inside the frame.

17. The mask according to claim 1, wherein the transparent portion (2) has a polygonal shape with squared radiusing facets.

18. The mask according to claim 17, wherein the transparent portion (2) is divided into a central portion (102), in relief, having a planar development and a polygonal shape, which is radiused with a parametric zone (202), adapted to couple with the frame (1) by way of surfaces with tilted polygonal shape (302, 402, 502).

* * * * *